United States Patent [19]

Gossie

[11] 4,026,755

[45] May 31, 1977

[54] DECAL APPLYING

[75] Inventor: Mijo A. Gossie, Corning, N.Y.

[73] Assignee: Corning Glass Works, Corning, N.Y.

[22] Filed: Feb. 9, 1976

[21] Appl. No.: 656,375

Related U.S. Application Data

[62] Division of Ser. No. 586,241, June 12, 1975, Pat. No. 3,960,633.

[52] U.S. Cl. ..... 156/538; 156/285; 156/574; 156/DIG. 31; 156/DIG. 38

[51] Int. Cl.[2] ..... B65C 9/14; B65C 9/28

[58] Field of Search ..... 156/540, 541, 542, 285, 156/497, 538, 568, 567, 568, 493, 556, 584, 566, 570, 382, 571, 572, 574, DIG. 37, DIG. 38, DIG. 31; 271/90, 194, 195, 197; 279/3; 294/64 R, 64 A, 65; 221/211, 278

[56] References Cited

UNITED STATES PATENTS

| | | | |
|---|---|---|---|
| 2,878,953 | 3/1959 | Mitchell | 156/271 |
| 3,294,434 | 12/1966 | Sinn | 271/90 |
| 3,307,869 | 3/1967 | Worfel | 294/64 R |
| 3,657,405 | 4/1972 | Langecker | 156/518 |
| 3,729,362 | 4/1973 | French et al. | 156/542 |
| 3,888,724 | 6/1975 | Spannknebel et al. | 156/541 |
| 3,943,023 | 3/1976 | Weingrad | 156/540 |

*Primary Examiner*—Charles E. Van Horn
*Assistant Examiner*—Michael W. Ball
*Attorney, Agent, or Firm*—Charles W. Gregg; Burton R. Turner; Clarence R. Patty, Jr.

[57] ABSTRACT

The present invention relates to decal applying and more specifically to an apparatus for and a method of stripping the backing paper of a water-soaked water-release slide-off decal from the transfer film of the decal and applying such transfer film to a surface of a dish-like article to be decorated.

1 Claim, 23 Drawing Figures

CRA
PRI
CM
CMa
CMb
FC7
33a
33
33b
34
36
35
SB
VBHI
38
FC10
38a
47
39
44
40
46
55
44
60
61
57
54
58
48
58
51
58
58
49
14
49
53
52
57
56
52
53
14

DECAL APPLYING

This is a division of application Ser. No. 586,241 filed June 12, 1975.

BACKGROUND OF THE INVENTION

It has heretofore been the practice to manually strip or slide off the backing paper of a water-soaked water-release slide-off decal from the transfer film of the decal during the applying of the transfer film to a surface to be decorated, such as for example, a surface of a dish or dish-like article. Such a manual practice is relatively tedious and time consuming and, therefore, uneconomical. Accordingly, the apparatus and method of the present invention were developed for the stripping of the backing paper of a water-soaked water-release slide-off decal from the transfer film of the decal and for applying such transfer film to the surface of an article to be decorated.

SUMMARY OF THE INVENTION

The invention is believed to be adequately summarized in the foregoing abstract of the disclosure and, therefore, to prevent repetition or redundancy and for the sake of brevity to the extent possible, no further summary of the invention is believed necessary nor will any be given.

BRIEF DESCRIPTION OF THE DRAWINGS

In the drawings.

Similar reference characters refer to similar parts in each of the Figs. of the drawings.

PREFERRED EMBODIMENT OF THE INVENTION

Figure 1:
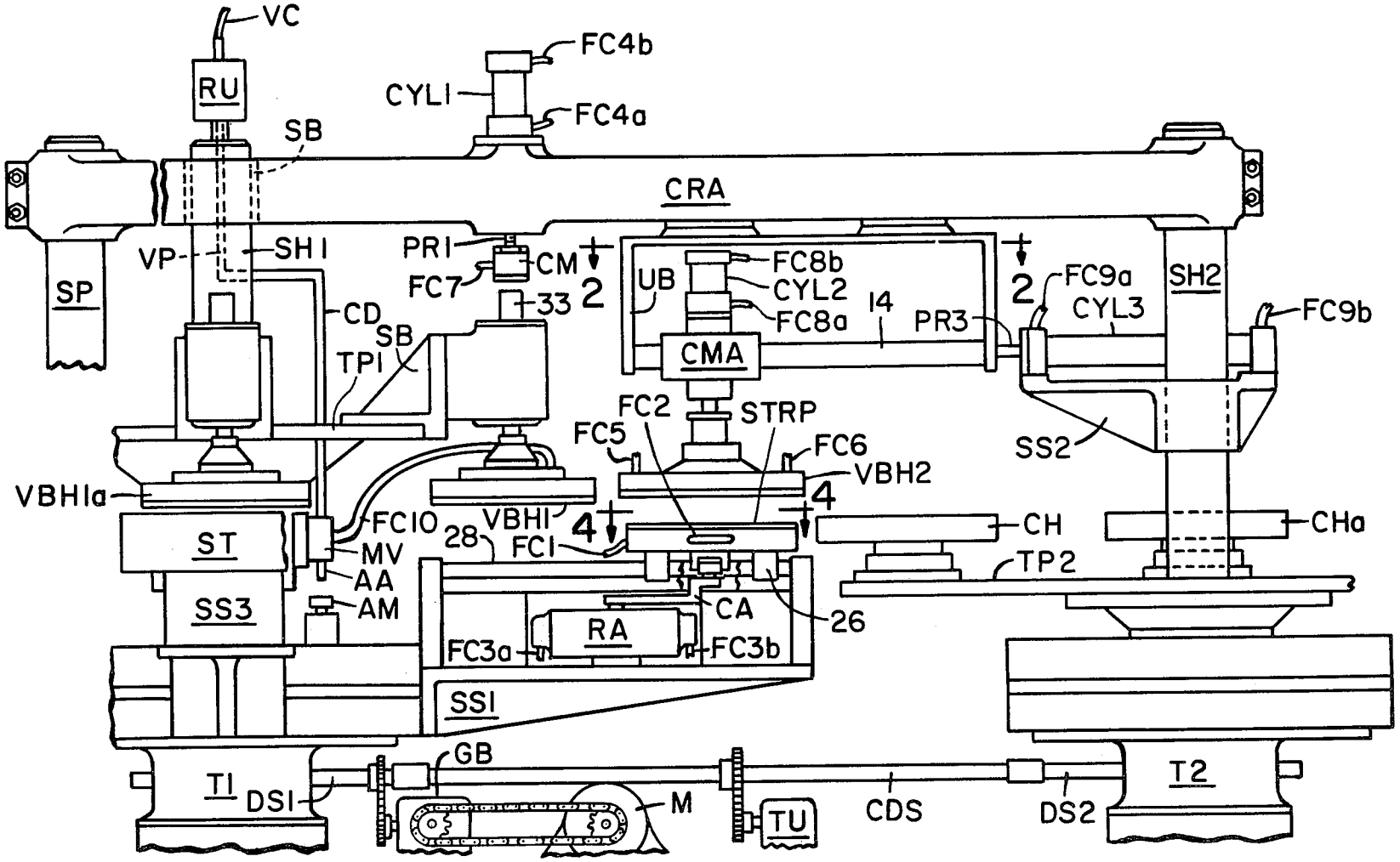
FIG. 1 comprises a diagrammatic view of apparatus used in practicing the invention disclosed and illustrating the general layout of such apparatus.

Referring to FIG. 1 of the drawings, there is shown the general layout or arrangement of apparatus used in practice of the invention. Such apparatus comprises a first indexing turret machine T1 which supports a tool plate TP1 for intermittent rotational and vertical reciprocating movement of such tool plate when a motor M is energized to drive, through a suitable gear box GB and suitable chain and sprocket arrangements, a drive shaft DS1 of turret machine T1. A drive shaft DS2 of a second indexing turret machine T2 is connected through a connecting drive shaft CDS to drive shaft DS1 and turret machine T2 is thereby driven in synchronism with turret machine T1. Turret machine T2 supports a tool plate TP2 for intermittent rotational movement of such tool plate when said motor M is energized. Turret machines such as T1 and T2 are well known.

There is attached to the upper surface of tool plate TP1 a support bracket SB which supports a first vacuum and blow head assembly VBH1 above a first position in a horizontal path of travel of a decal stripping plate STRP, such stripping plate being shown in its second position in said path of travel below a second vacuum and blow head assembly VBH2 which is horizontally movable through a second horizontal path of travel extending from said second position to a third position above a chuck CH carried on the upper surface of said tool plate TP2 of turret machine T2.

Previously mentioned decal stripping plate is actuated through its said horizontal path of travel and between said first and second positions in such path by a crank arm CA of a pneumatically driven rotary actuator RA to be hereinafter discussed in more detail, and vacuum and blow head assembly VBH2 is carried by a carriage member CMA and is actuated through said second horizontal path of travel and between said second and third positions in such path by a piston rod PR3 of a compressed air cylinder CYL3 supported on a shelf SS2 attached to the stationary center shaft SH2 of turret machine T2. Carriage member CMA and, thereby, assembly VBH2 is actuated to the left or right (viewing FIG. 1) according as compressed air is supplied over flexible fluid conduits FC9*b* and FC9*a*, respectively, connected to the right and left hand ends, respectively, of cylinder CYL3 as discussed hereinafter.

A cross arm CRA is supported at one end thereof by a support pedestal SP whose lower end rests on a floor or suitable platform (not shown) upon which also rests the lower ends of turret machines T1 and T2. The second end of cross arm CRA is attached to the upper end of said stationary center shaft SH2 of turret machine T2. The upper end of the rotational center shaft SH1 of turret machine T1 extends through a suitable sleeve bearing SB supported in cross arm CRA for rotation of such shaft in such bearing. At the upper end of shaft SH1 there is provided a rotary union RU whose lower end connects with a first or upper end of a vacuum passage VP provided in shaft SH1 and whose upper end connects with a vacuum conduit VC and thence with a source of vacuum as hereinafter further discussed. The second end of vacuum passage VP in shaft SH1 connects to a first end of a pipe or conduit CD which connects with a mechanically actuated vacuum flow control valve MV also to be hereinafter discussed. Rotary unions such as RU are well known.

Cross arm CRA supports on its upper surface a compressed air cylinder CYL1 whose piston rod PR1 is connected to a contacting or contact member CM which is actuated by piston rod PR1 into and out of contact with the upper end of a hollow shaft 33 supporting vacuum and blow head assembly VBH1 according as compressed air is supplied to flexible compressed air conduits FC4*b* and FC4*a*, respectively, connected to the upper and lower ends of cylinder CYL1, respectively. This is further discussed hereinafter. Crossarm CRA also supports an inverted U-shaped bracket UB which slidably supports the aforesaid carriage member CMA and an associated compressed air cylinder CYL2, such carriage member CMA carrying such cylinder and vacuum and blow head assembly VBH2 through said second horizontal path of travel as mentioned above. Vacuum and blow head assembly VBH2 is actuated to lowered and raised positions according as compressed air is supplied over flexible compressed air conduits FC8*b* and FC8*a*, respectively, connected to the upper and lower ends, respectively of cylinder CYL2. This is also discussed hereinafter.

Decal stripping plate STRP is, as discussed hereinafter, supported for sliding movement through its horizontal path of travel by a support shelf SS1 suitably attached to the side of turret machine T1. Another support shelf SS3 supports at the upper end thereof a decal soak tank ST above which there is shown a vacuum and blow head assembly VBH1*a* which is supported on tool plate TP1 similarly to assembly VBH1 and which will be further mentioned hereinafter. A second chuck CH*a* is also shown supported on the upper surface of tool plate TP2 of turret machine T2 and will also be further mentioned hereinafter.

Having thus far described the general layout or arrangement of the apparatus used in practicing the invention, a more detailed discussion of parts of the apparatus will be set forth.

Figure 2:
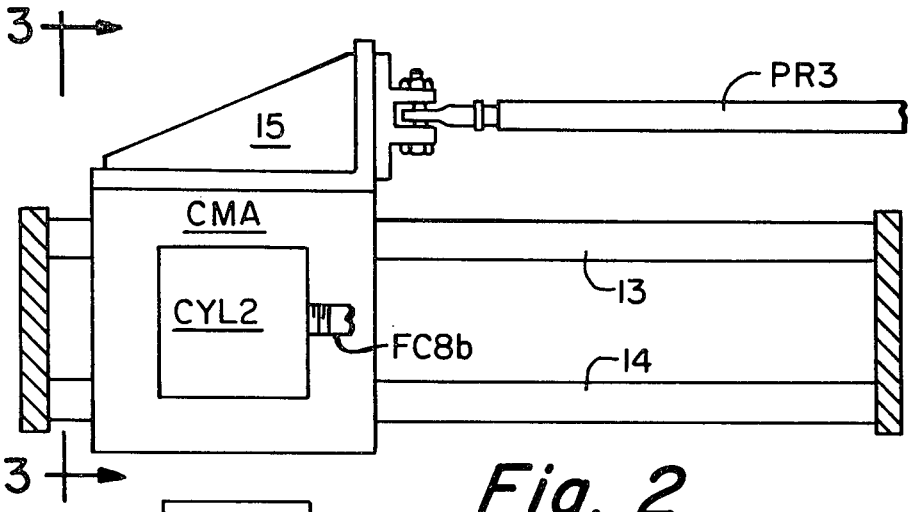
FIG. 2 is a top plan view of part of the apparatus of FIG. 1, such view being taken generally along line 2—2 of FIG. 1.
Figure 3:
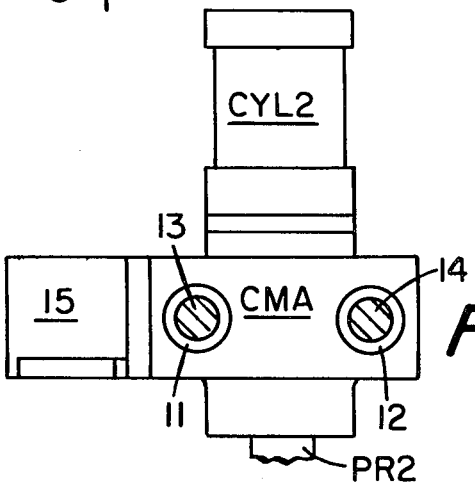
FIG. 3 is an end view of the part of the apparatus shown in FIG. 2, such view being taken generally along line 3—3 of FIG. 2.
Figure 15:
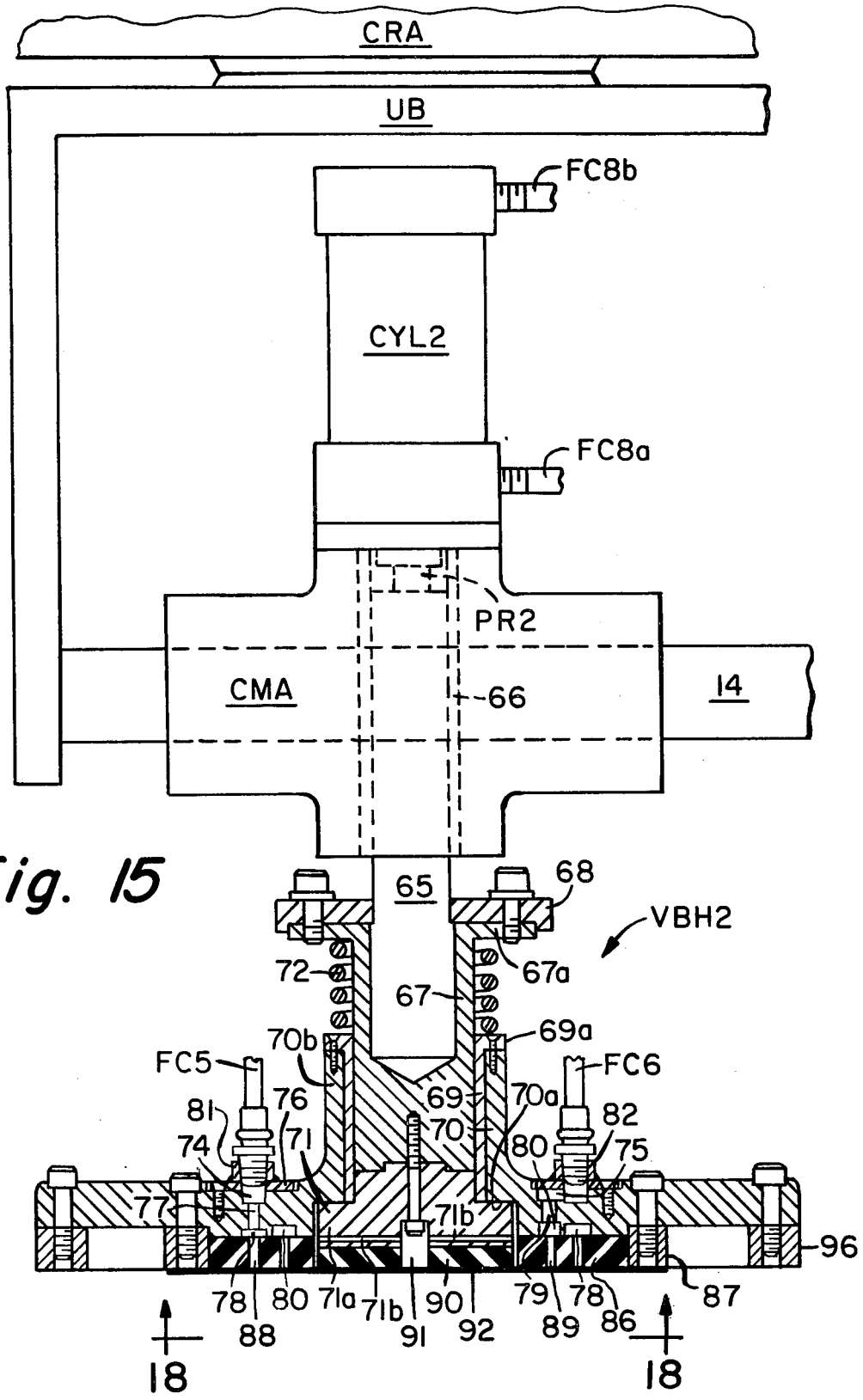
FIG. 15 is a cross-sectional elevational view of a second vacuum and blow head assembly used in practicing the invention disclosed.
Figure 17:
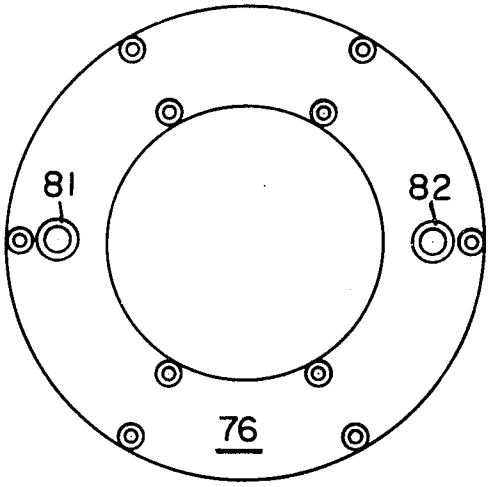
FIG. 17 is a top plan view of another part of the vacuum and blow head assembly of FIG. 15.

Referring to FIGS. 2, 3 and 15 of the drawings in detail, previously mentioned carriage member CMA embodies a pair of bushings 11 and 12 through which there extends tubular rails 13 and 14, respectively, supported at their ends by the aforesaid U-shaped bracket UB so that carriage member CMA is slidably supported on said rails for horizontal movement thereof. A bracket is secured to the back side (viewing FIGS. 1 and 2) of carriage member CMA and there is pivotally linked to such bracket the otherwise free end of previously mentioned piston rod PR3 of compressed air cylinder CYL3 (FIG. 1). By such arrangement selectively supplying pressurized fluid to first and second ends of cylinder CYL3 moves carriage member CMA and, thereby, cylinder CYL2 and vacuum and blow head assembly VBH2 attached thereto, through the previously mentioned second horizontal path of travel further hereinafter described.

Figure 6:
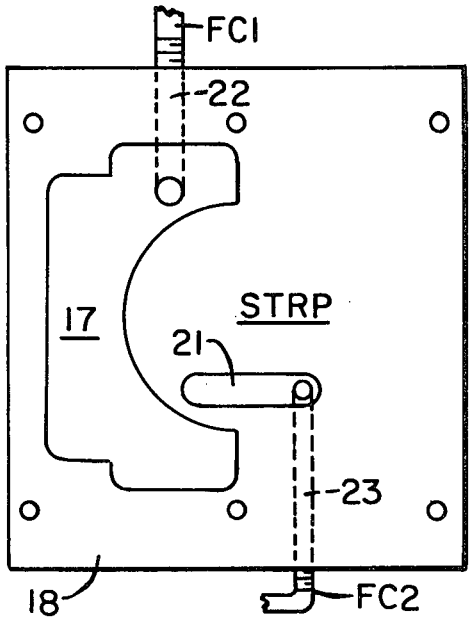
FIG. 6 is a top plan view of part of the apparatus of FIG. 5, such view being taken generally along line 6—6 of FIG. 5.
Figure 5:
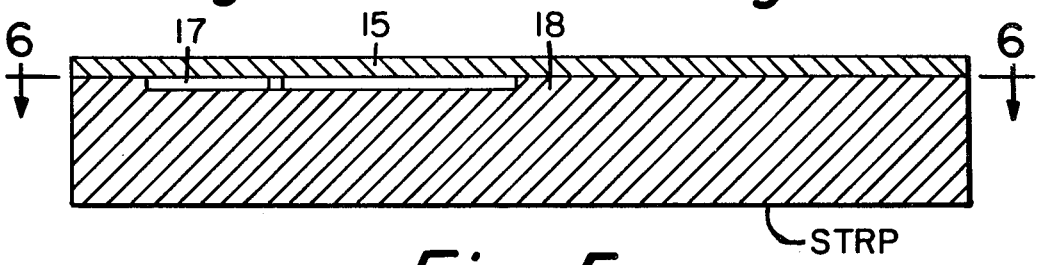
FIG. 5 is a cross-sectional view of the part of the apparatus of FIG. 4, such view being taken generally along line 5—5 of FIG. 4.

With reference to FIGS. 4 through 8 of the drawings, stripping plate STRP comprises a top plate 15 having a plurality of arcuate slots such as 16 extending vertically therethrough and connecting with a vacuum manifold 17 embodied in a body member 18 of such stripping plate. Top plate 15 also embodies a plurality of compressed air orifices such as 19 which extend vertically through such top plate and connect with a compressed air channel 21 also embodied in body member 18 (FIG. 6). Suitable fluid passages 22 and 23 extend through body member 18 of stripping plate STRP and connect vacuum chamber 17 and compressed air channel 21, respectively, with flexible vacuum and compressed air conduits FC1 and FC2, respectively, for purposes hereinafter discussed.

Figure 8:
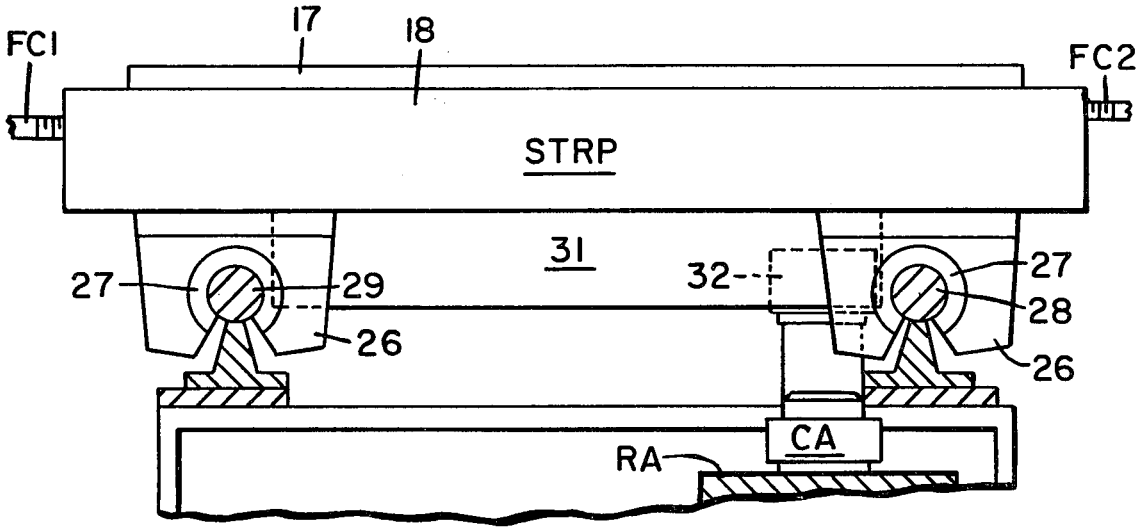
FIG. 8 is an end elevational view of the apparatus part of FIG. 7, such view being taken along line 8—8 of FIG. 7.
Figure 7:
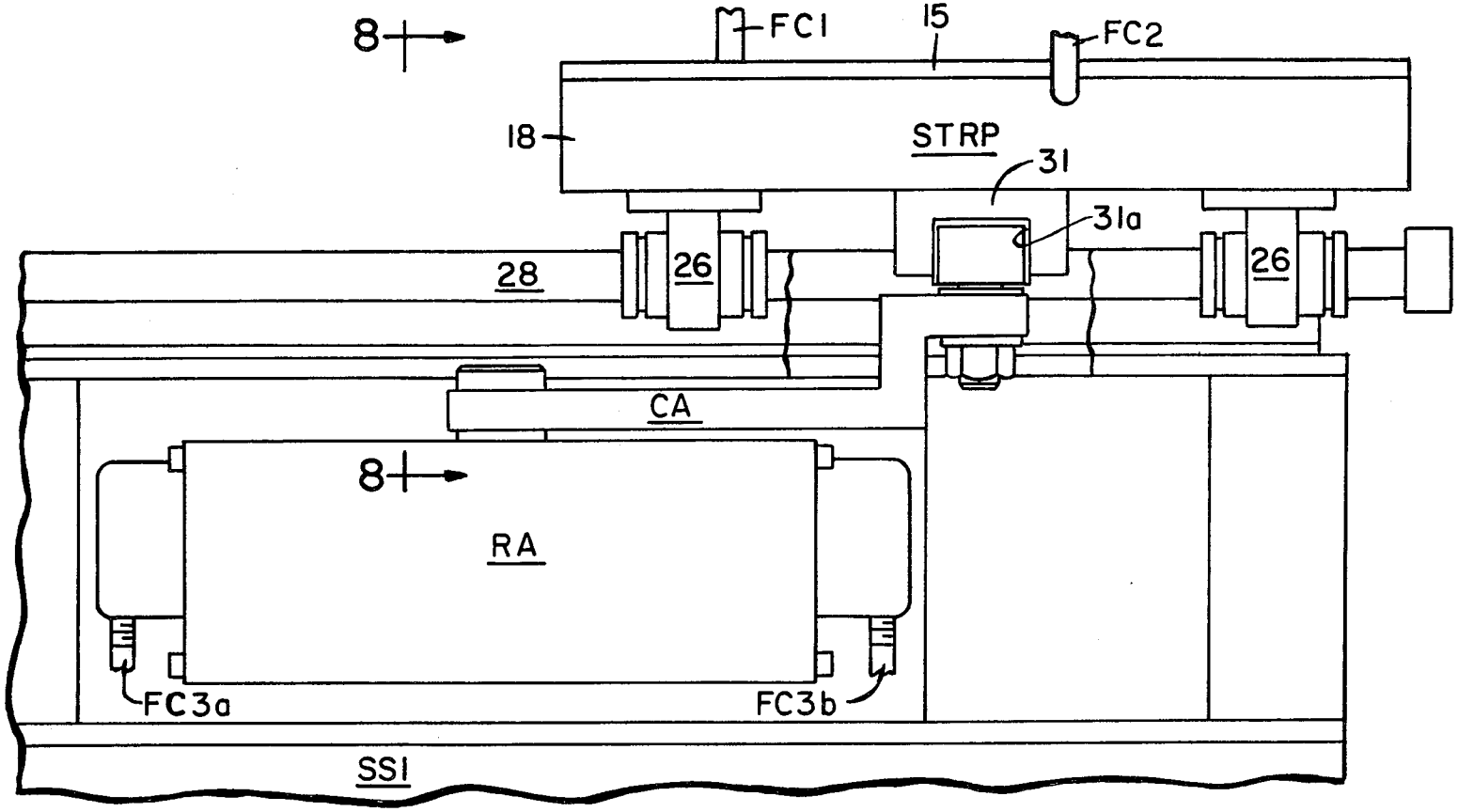
FIG. 7 is an elevational view of part of the apparatus of FIG. 1.

Referring in more detail to FIGS. 7 and 8 taken in conjunction with FIG. 1, there is attached to the bottom of stripping plate STRP downwardly extending supports such as 26 which embody bushings such as 27 through which there slidably extends tubular rails 28 and 29 whose ends are supported by previously mentioned shelf SS1. There is secured to the bottom of stripping plate STRP a channel member 31 into whose channel 31*a* (FIG. 7) there extends a cam follower 32 rotatably supported on the otherwise free end of previously mentioned crank arm CA carried by the output shaft of rotary actuator RA also previously mentioned. Actuator RA reciprocatively rotates its output shaft through approximately 180° of rotation to the left or to the right accordingly as compressed air is supplied to flexible conduits FC3*a* and FC3*b*, respectively, connected to the left and right hand ends, respectively, of actuator RA. This correspondingly rotates crank arm CA to the left or to the right (viewing FIG. 7) so that cam follower 31 moves in channel 31*a* in channel member 31 to actuate stripping plate STRP to the left or to the right, respectively, and thereby through the previously mentioned first horizontal path of travel of such stripping plate. In other words, the supplying of compressed air over conduit FC3*a* to the left hand end of actuator RA moves stripping plate STRP through its horizontal path of travel to said first position in such path while the supplying of compressed air over conduit FC3*b* to the right hand end of actuator RA moves stripping plate STRP to its second position in said path of travel, that is, to the right and to the position of such plate shown in FIG. 7. Rotary actuators such as RA are well known and such an actuator may, for example, be obtained from Flo-Tork, Inc. whose address is Orrville, Ohio 44667.

Referring now to FIGS. 9 through 14, there is shown in detail previously mentioned vacuum and blow head assembly VBH1 supported by a vertical hollow support shaft 33 with a compressed air passage 33*a* extending through the length of such shaft. Compressed air is supplied to said passage 33*a* when previously mentioned contact member CM attached to piston rod PR1 of compressed air cylinder CYL1 (FIG. 1) is actuated downwardly, as hereinafter discussed, to contact the upper end of shaft 33 and compressed air is supplied over a flexible conduit FC7 to an air passage CM*a* embodied in contact member CM. There is secured to the lower face of member CM, as by a suitable adhesive or glue, a rubber washer or annular member CM*b* for making substantially hermetic contact with the upper end of shaft 33.

Shaft 33 extends downwardly through a bushing 34 embodied in the hollow of a support hub 35 supported by previously mentioned support bracket SB. A compressible coil spring 36 surrounds shaft 33 within the hollow of bushing 34 and bears upwardly against an enlarged portion 33*b* of shaft 33 to normally urge such shaft to an upper position within bushing 34. The lower end of shaft 33 is attached to a body member 38 of head assembly VBH1, such body member embodying a compressed air chamber 38*a* through which compressed air at times flows to passages in the lower end of the assembly VBH1 as discussed below.

Figure 9:
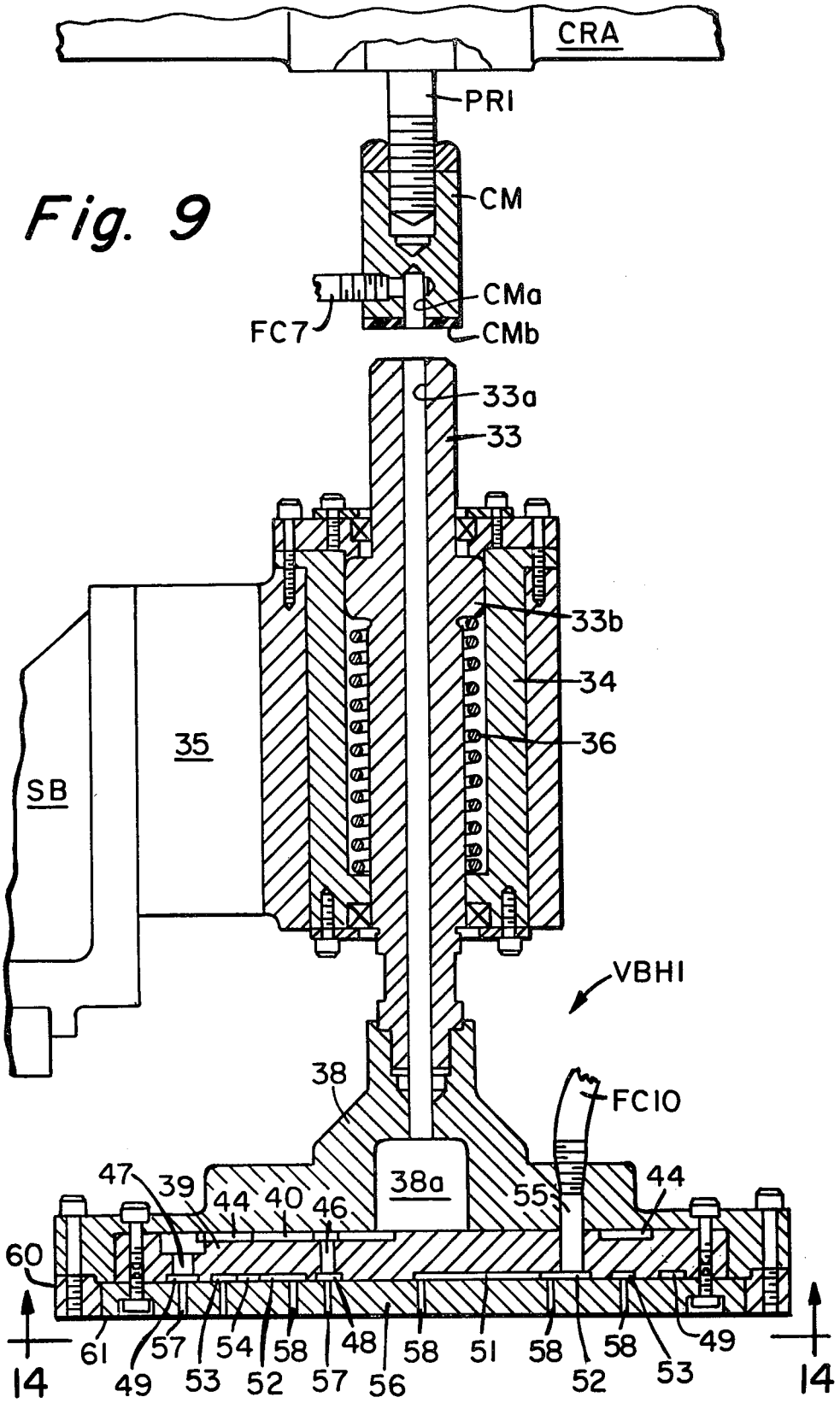
FIG. 9 is a cross-sectional elevational view of a first vacuum and blow head assembly used in practicing the invention disclosed.
Figure 10:
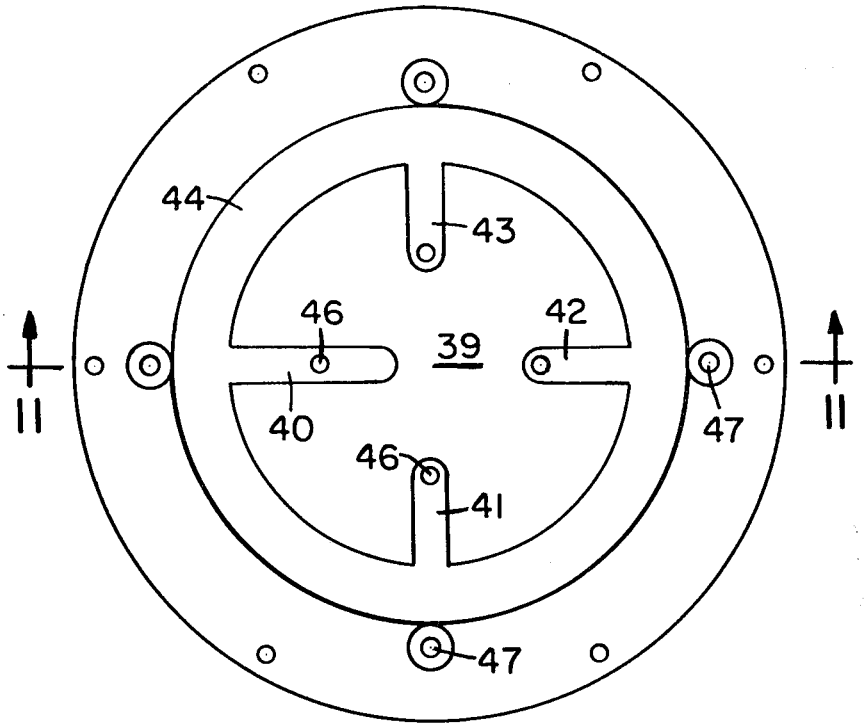
FIG. 10 is a top plan view of a part of the vacuum and blow head assembly of FIG. 9.
Figure 11:
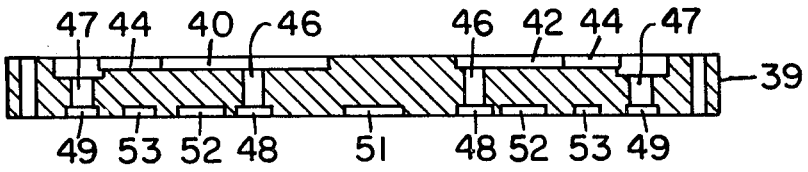
FIG. 11 is a cross-sectional view of the assembly part of FIG. 10, such view taken generally along line 11—11 of FIG. 10.
Figure 12:
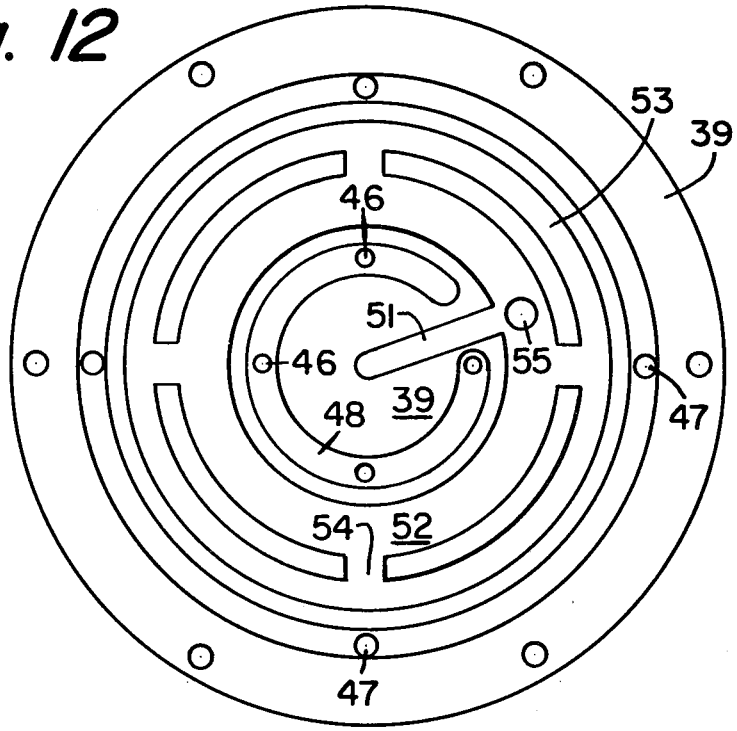
FIG. 12 is a bottom plan view of the assembly part of FIG. 10.
Figure 13:
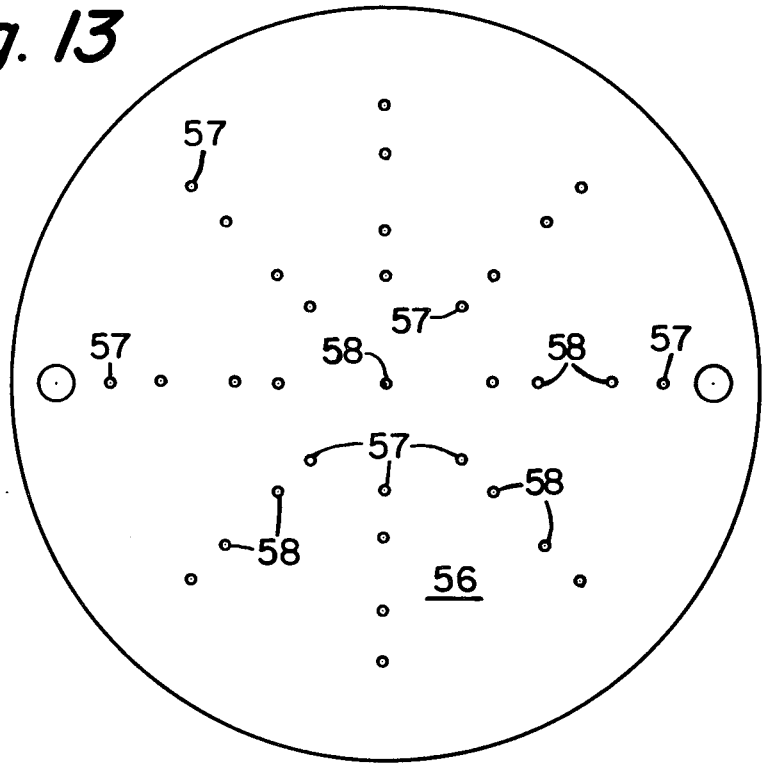
FIG. 13 is a bottom plan view of another part of the assembly of FIG. 9.
Figure 14:
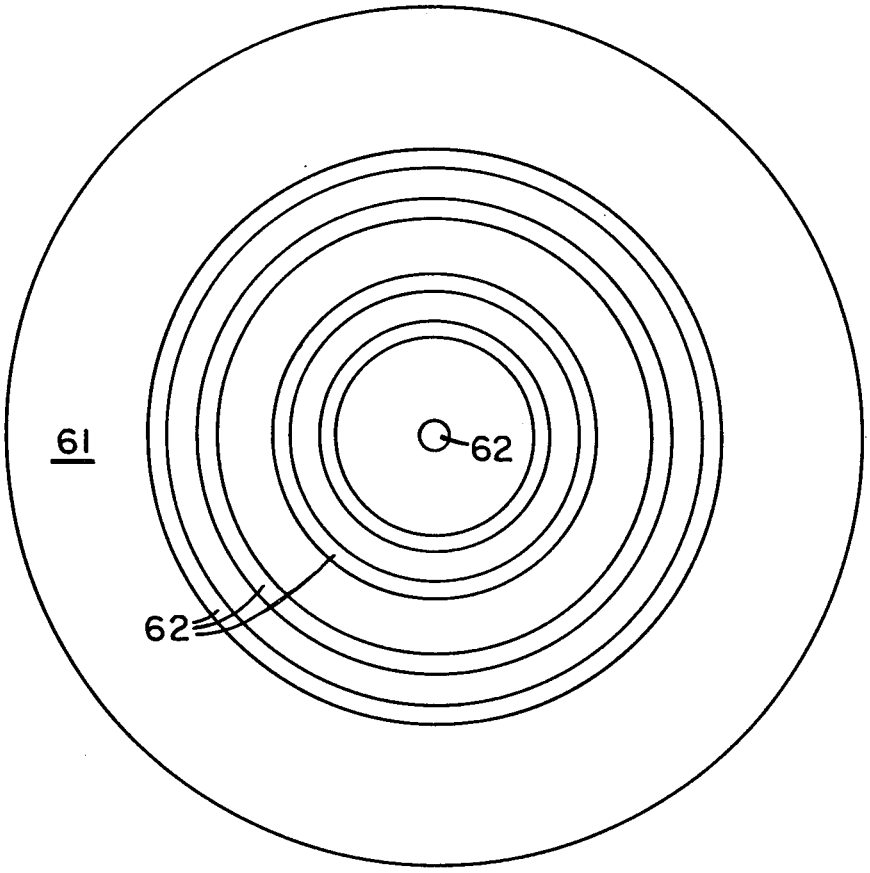
FIG. 14 is a bottom plan view of the assembly of FIG. 9, such view being taken generally along line 14—14 of FIG. 9 and illustrating a silk screen which is attached to an outer annular part of said assembly.

Referring to FIGS. 10, 11 and 12 taken in conjunction with FIG. 9, FIG. 10 shows the upper side of a central plate member 39 of head assembly VBH1, such upper side embodying in the surface thereof (FIG. 10) a plurality of radial compressed air passages 40, 41, 42 and 43 whose outer ends communicate or connect with an annular passage 44 which, in turn connects with passages such as 46 and 47 extending vertically through plate member 39. The inner end of radial passage 40 connects with previously mentioned compressed air manifold 38*a* embodied in body member 38. FIG. 12, taken in conjunction with FIGS. 9 and 11 shows the lower side of plate member 39 of head assembly VBH1, such lower side embodying in the surface thereof an inner almost completely circular compressed air passage 48 which communicates or connects with the lower ends of said passages such as 46 extending through plate member 39, and an outer annular compressed air passage 49 which communicates or connects with the lower ends of said passages such as 47.

The lower side of plate member 39 of assembly VBH1 also embodies in the surface thereof a radial vacuum passage 51 which communicates with a first annular vacuum passage 52 which in turn communicates, by short radial passage such as 54, with a second annular vacuum passage 53. A vacuum passage 55 (FIG. 9) extends downwardly through body member 38 and plate member 39 to communicate with annular passage 52, and a flexible vacuum conduit FC10 (FIG. 9) is connected to the upper end of vacuum passage 55 to at times supply vacuum to said passages 51, 52, 53 and 54 as hereinafter described.

A second plate member 56 (FIGS. 9 and 13) has its upper surface disposed against the lower surface of plate member 39 and such plate member 56 embodies a first plurality of compressed air passages such as 57 which extend vertically therethrough and communicate with associated ones of the aforesaid compressed air passages of plate member 39, and a second plurality of holes such as 58 which also extend vertically through plate member 56 and communicate with associated ones of the aforesaid vacuum passages of plate member 39. An annular member or ring 60 (FIG. 9) is secured to the bottom of body member 38 of assembly VBH1 adjacent the outer periphery thereof, such annular member 60 surrounding member 39. There is secured to the lower surface of such annular member 60, as by using a suitable water proof glue or adhesive, an outer annular area of a silk screen 61 (FIG. 14) which has a plurality of annular areas such as 62 of relatively open mesh for ready passage of compressed air or vacuum therethrough. Such annular areas coincide with or lie below the said lower ends of the compressed air and vacuum passages such as 57 and 58 provided in plate member 56 as is believed will readily be apparent from brief glances at FIGS. 13 and 14 of the drawings.

With reference to FIGS. 15 through 19 of the drawings, vacuum and blow head assembly VBH2 is supported by a vertical stem or shaft 65 which is attached at its upper end to the otherwise free end of piston rod PR2 of compressed air cylinder CYL2 supported on the upper side of carriage member CMA and previously discussed. Stem or shaft 65 extends slidably downwardly through a bushing 66 embodied in carriage member CMA and thence into the upper end of a partially hollow core member 67 having an upper flange 67*a* by which such core member is attached to a ring member 68 which closely surrounds stem or shaft 65 above a portion thereof of an increased diameter. By the arrangement shown in FIG. 15, it will be apparent that ring and core members 67 and 68 are supported by stem or shaft 65.

The lower end of core member 67 fits slidably into a sleeve 69 having a flange 69*a* at its upward end by which the sleeve 69 is fastened to an upwardly extending hub portion 70*b* of a body member 70 of vacuum and blow head assembly VBH2. There is attached to the lower end of core member 67 a plug member 71 having a larger diameter at its lower end than at its upper end to provide a shoulder portion 71*a* upon whose upper surface there rests the lower end of said sleeve 69 and the lower surface 70*a* of a recessed portion of body member 70 into which said shoulder portion 71*a* of plug member 71 extends. A compressible coil spring 72 surrounds the upper part of core member 67 and the upper end of such spring bears against the lower surface of flange 67*a* of core member 67 while the lower end of spring 72 bears against the upper surface of flange 69*a* of sleeve 69. By such arrangement it is apparent that spring 72 normally urges sleeve 69 and, thereby, body member 70 downwardly so that plug member 71 is normally retracted within said recessed portion of body member 70. This will be further discussed hereinafter.

Figure 16:
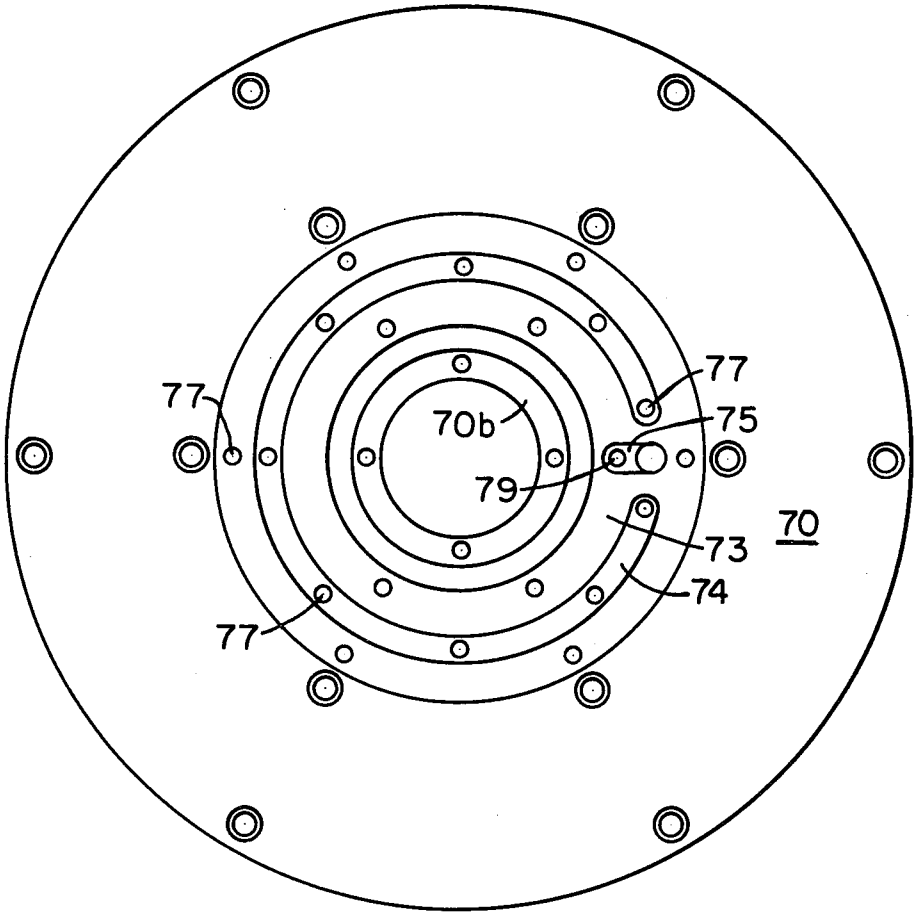
FIG. 16 is a top plan view of a part of the vacuum and blow head assembly of FIG. 15.
Figure 18:
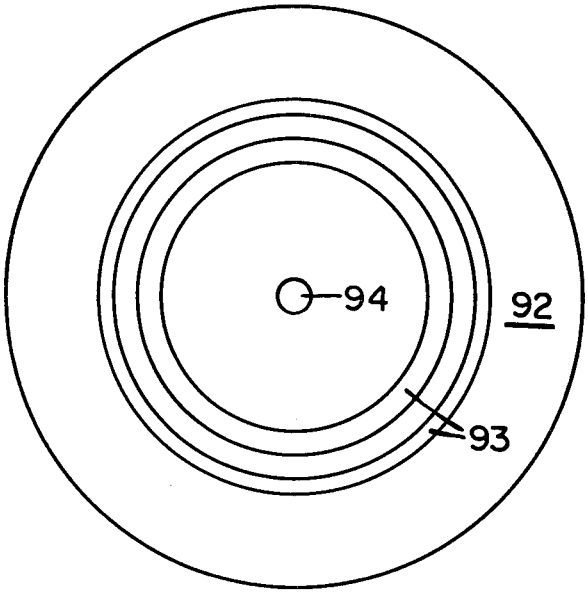
FIG. 18 is a bottom plan view of part of the assembly of FIG. 15, such view being taken generally along line 18—18 of FIG. 15 and illustrating a silk screen which is attached to an annular part of said assembly.

Referring to FIG. 16, which is a top plan view of body member 70 of assembly VBH2, such body member has in its upper surface a relatively shallow channel 73 in the bottom of which channel there is embodied a nearly completely circular vacuum passage 74 and a short radially extending compressed air passage 75. (See also FIG. 15.) Such passages 74 and 75 are sealed off at their upper sides by an annular plate 76 (FIG. 17) which fits into and is affixed in the aforesaid shallow channel 73 in the upper surface of body member 70. Channel 74 is connected, by vacuum passages such as 77 extending vertically through member 70, with an annular vacuum passage 78 (FIG. 15) embodied in the bottom surface of body member 70 and extending annularly thereabout. Similarly, the inner end of radial passage 75 is connected, by a compressed air passage 79 extending vertically through member 70, with an annular compressed air passage 80 (FIG. 15) embodied in the bottom surface of body 70 and extending annularly thereabout. Vacuum is supplied to vacuum passage 74, in body member 70, by a flexible conduit FC5 (FIG. 15) which is connected through a suitably threaded boss 81 on annular plate 76 (FIGS. 15 and 17) to such vacuum passage 74. Similarly, compressed air is supplied to compressed air passage 75 in body member 70 by flexible conduit FC6 which is connected, through a suitably threaded boss 82 on annular plate 76, to such compressed air passage 75.

Figure 19:
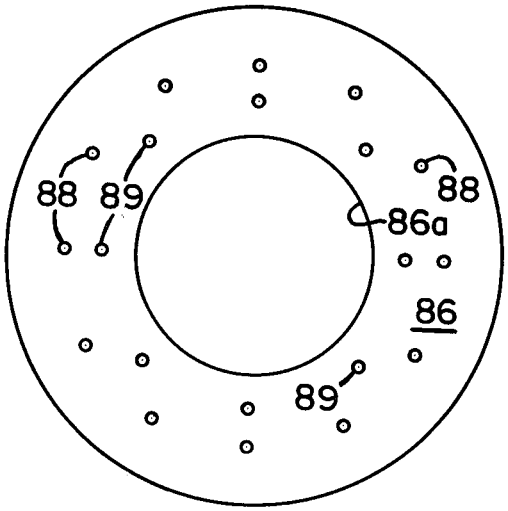
FIG. 19 is a bottom plan view of another part of the assembly of FIG. 15.

With reference to FIG. 19, taken in conjunction with FIG. 15, an annular member 86 of a resilient material such as rubber, for example, is affixed, as by a suitable water proof glue or adhesive, to the bottom surface of body member 70 in a central portion thereof defined by an inner ring or annular member 87 also secured to the bottom of body member 70. The center hole **86*a* in annular member 86 is of a slightly larger diameter than the aforementioned larger diameter shoulder portion 71*a* of plug member 71. Annular member 86 embodies a first plurality or outer circular row of vacuum passages such as 88 which extend vertically through such member and connect at their upper ends with annular vacuum passage 78 embodied in the bottom surface of body member 70. Similarly annular member 86 embodies a second plurality or inner circular row of compressed air passages such as 89 which extend vertically through such member and connect at their upper ends with annular compressed air passage 80 embodied in the bottom surface of body member 70**.

There is disposed in center hole **86*a* of resilient annular member 86 a central member 90 (FIG. 15) of a resilient material such as rubber, for example, such central member having a center hole 91 therein which connects with radial passages such as 71*b* provided in plug member 71 for purposes hereinafter discussed. A circular silk screen 92 (FIG. 18) is secured to the bottom surface of the aforesaid ring or annular member 87 (FIG. 15) as by being affixed to such surface by a suitable water proof adhesive or glue. Such silk screen includes open mesh areas such as 93 which coincide or lie beneath the lower ends of the aforesaid passages such as 88 and 89 provided in member 86 for the ready passage of compressed air or vacuum through the silk screen. A small circular open mesh area 94 in the center of silk screen 92 also coincides or lies beneath the aforesaid center hole or passage 91 in said central member 90. A second ring or outer annular member 96 (FIG. 15) is secured to the bottom of body member 70 adjacent the outer perimeter of such body member. The purpose of annular member 96** is discussed below.

Figure 20:
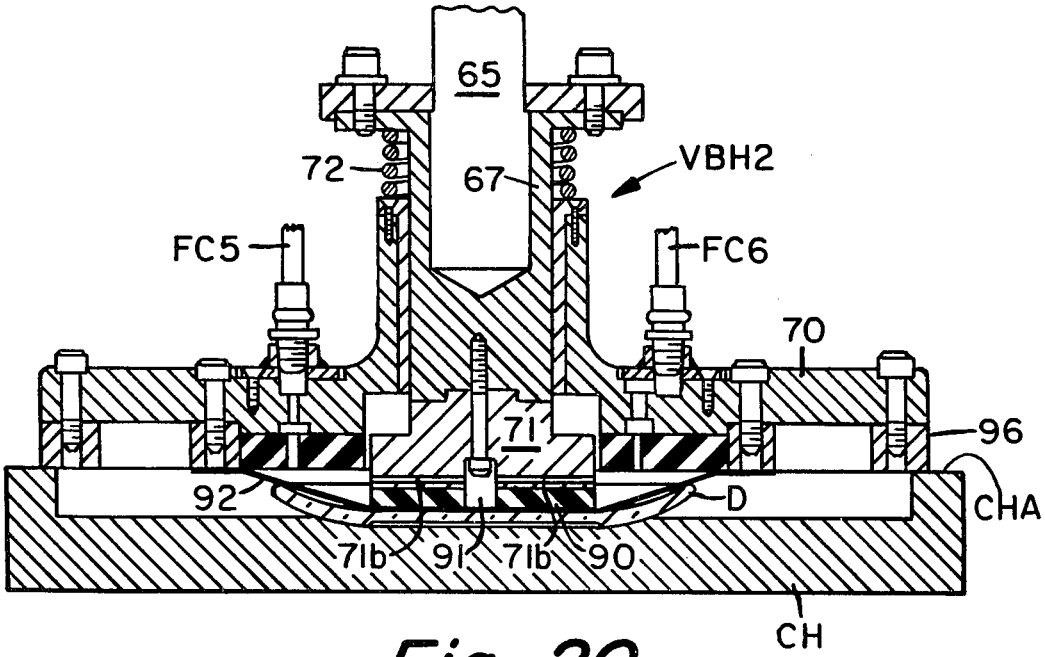
FIG. 20 is another cross-sectional elevational view of the second vacuum and blow head assembly of FIG. 15, such view illustrating such assembly in an actuated position thereof.
Figure 4:
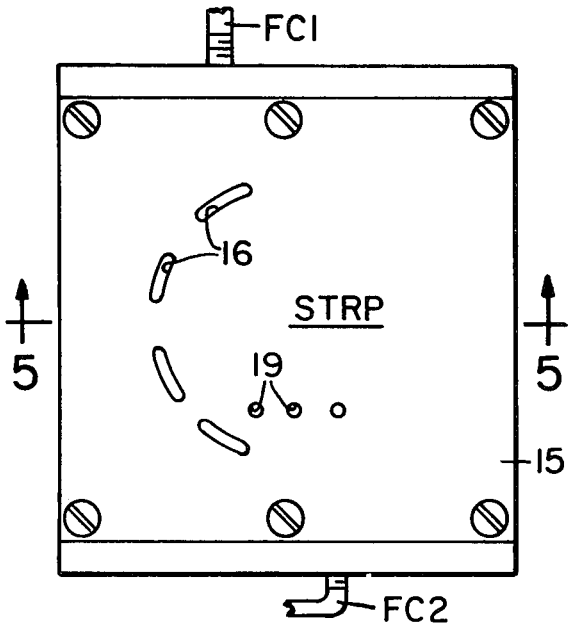
FIG. 4 is a top plan view of another part of the apparatus of FIG. 1, such view being taken generally along line 4—4 of FIG. 1.

In FIG. 20 vacuum and blow head assembly VBH2 is illustrated in an actuated condition thereof. That is to say, when assembly VBH2 is, as hereinafter discussed, actuated downwardly by stem or shaft 65 thereof and such assembly is at such time disposed above previously mentioned chuck CH carried by tool plate TP2 (FIG. 1) containing a dish or dish-like article such as D (FIG. 20) to whose upper surface a decal is to be applied, the bottom of ring or outer annular member 96 contacts the outer peripheral rim CH*a* of chuck CH and further downward actuation of most of the assembly VBH2 is halted. However, at such time, core member 67 of the assembly continues downwardly within sleeve 69 to compress spring 72 and also move plug member 71 and central resilient member 90 downwardly to stretch silk screen 92 and press the transfer film (not shown) of a decal and the decoration on such transfer film against and onto the upper surface of dish or dish-like article D for transfer thereto, compressed air also being used at such time to aid in such transfer. This is further discussed hereinafter.

Figure 21:
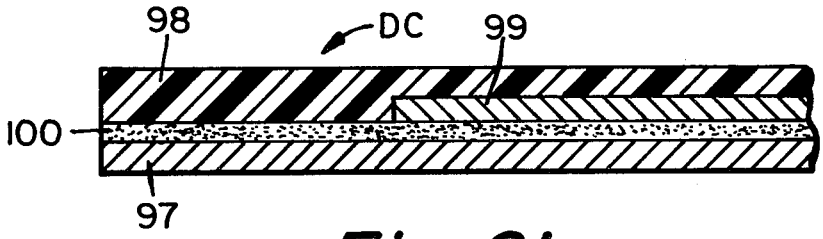
FIG. 21 is a cross-sectional view on a greatly enlarged scale of a part of a water-release slide-off decal used in practicing the invention disclosed.

There is shown in FIG. 21, on a greatly exaggerated scale as previously mentioned, a water-release slide-off decal DC such as is used in practicing the present invention. Such decal comprises a backing paper 97, a stretchable transfer film 98 including, on a portion of one surface thereof a decoration 99, and a layer of water soluble glue or similar adhesive 100 between said one surface of the transfer film and the surface of the backing paper on which the other parts of the decal are supported. Decals such as DC are well known in the art.

Figure 22:
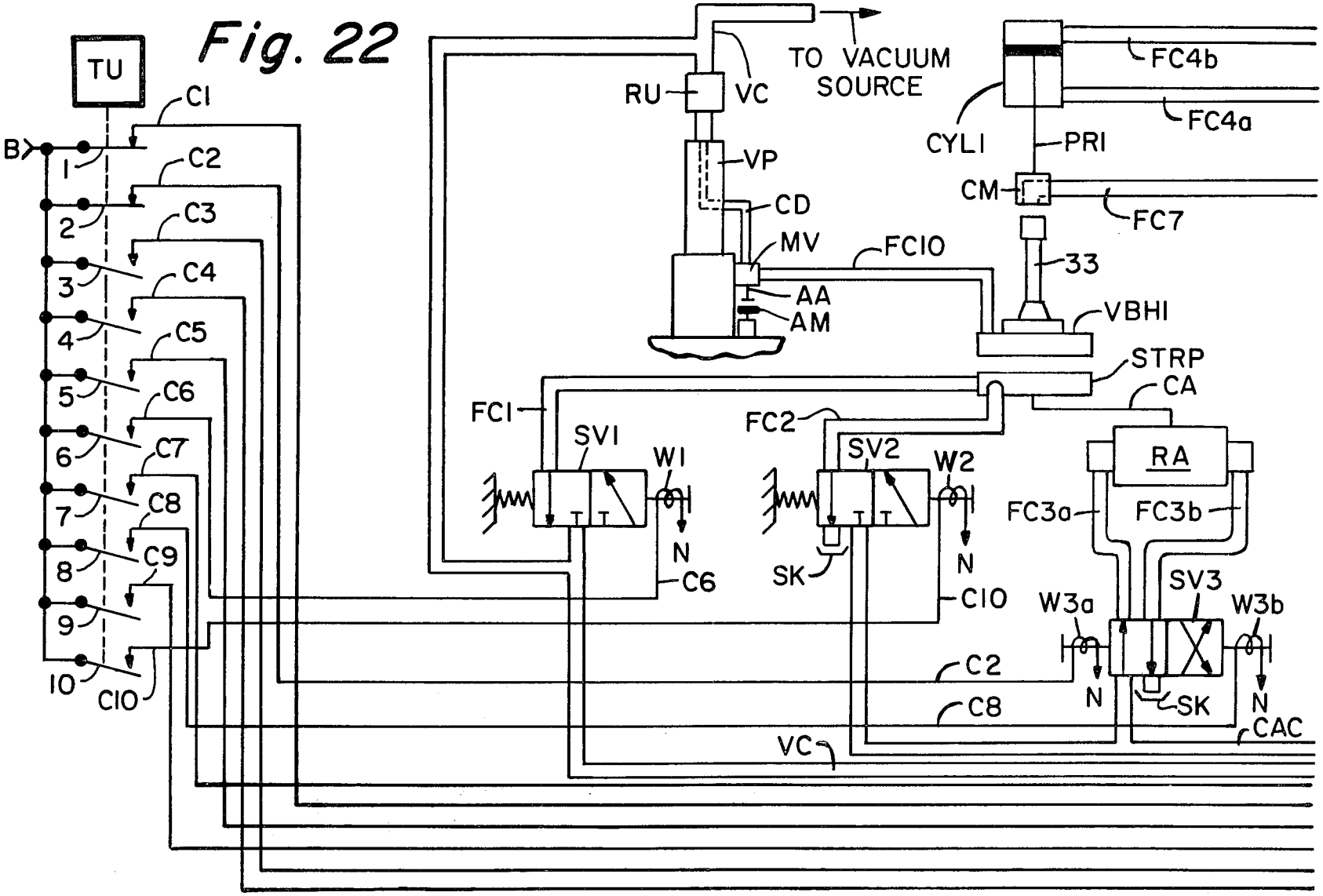
FIGS. 22 and 23 are pneumatic and electrical schematic drawings which, when arranged side by side with FIG. 22 on the left, illustrate one form of a control system which may be used in practicing the invention disclosed.
Figure 23:
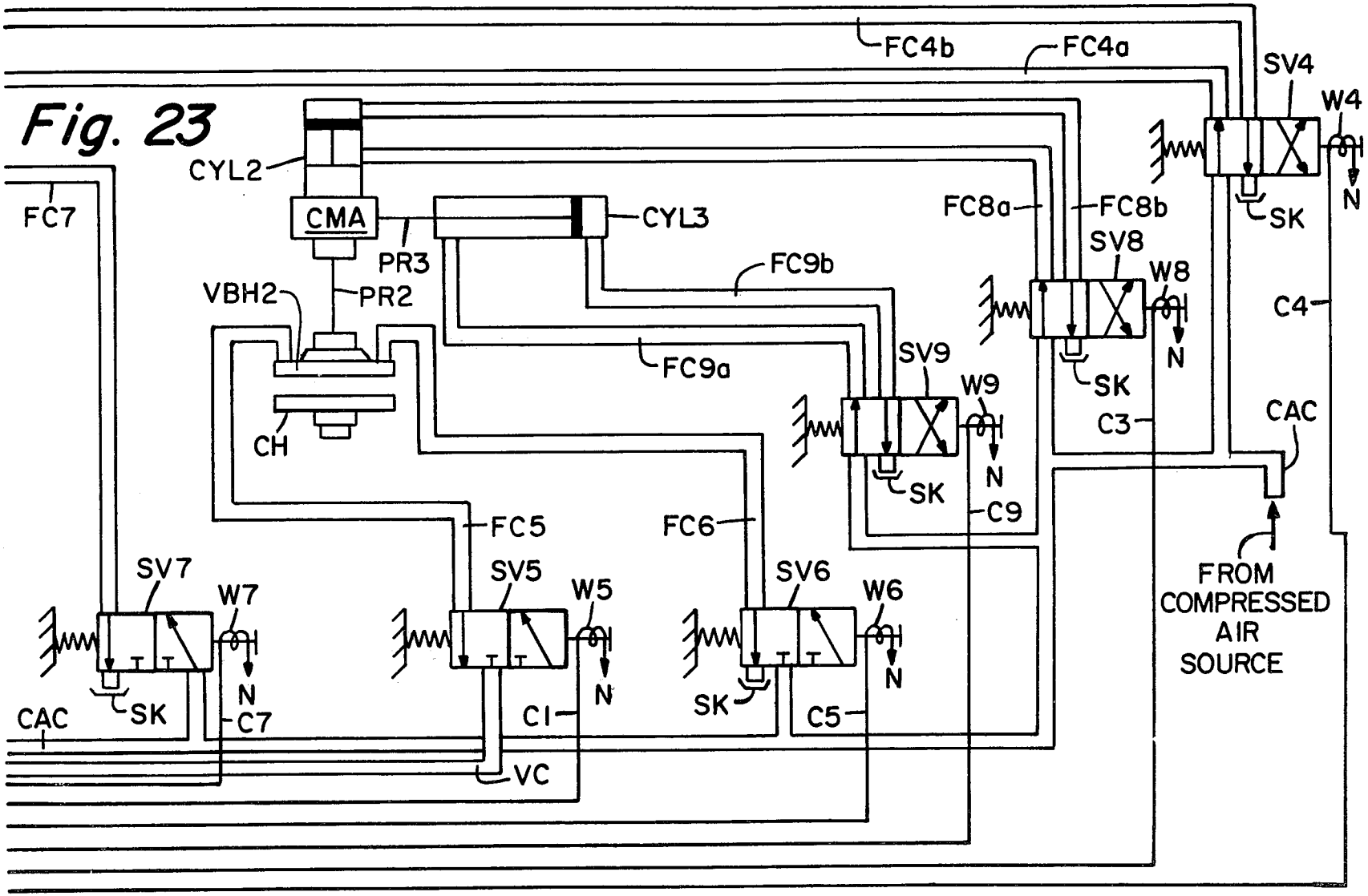

Referring to FIGS. 22 and 23 which, as previously mentioned, illustrate one form of a control system which may be used in practicing the invention disclosed, there is shown in the upper left hand corner of FIG. 22 a timing unit or drum TU which is also shown in FIG. 1 and which is driven in synchronism with turret machines T1 and T2 by means of a suitable chain and sprocket arrangement (FIG. 1) which are driven by the aforementioned connecting drive shaft CDS extending between the drive shafts DS1 and DS2 of turret machines T1 and T2. Timing unit TU selectively actuates a plurality of electrical circuit controlling contacts 1 through 10 (FIG. 22) between open and closed conditions to, in turn, selectively energize or deenergize electrical conductors C1 through C10 and, thereby the solenoid windings of a plurality of electric solenoid actuated vacuum and compressed air flow control valves SV1 through SV9 as discussed below. Solenoid actuated valves such as SV1 through SV9 are well known.

It will be assumed, for purposes of a detailed discussion of the control system shown in FIGS. 22 and 23 of the drawings, that turret machine T1 (FIG. 1) has just moved vacuum and blow head assembly VBH1 to its position shown in FIG. 1 from the position of assembly VBH1*a* also shown in FIG. 1 where assembly VBH1 was lowered into soak tank ST in which a water-release slide-off decal carried on the bottom of assembly VBH1 was wetted for subsequent separation of the transfer film and associated decoration from the backing paper of a decal such as decal DC shown in FIG. 21, and previously discussed. In other words, a vertical actuation of turret T1 is about to occur to move vacuum and blow head assembly downwardly towards stripping plate STRP which, at such time, is in its aforesaid first position of its previously mentioned horizontal path of travel. At such time circuit controlling contacts 1 and 2 of timing unit TU (FIG. 22) are closed while contacts 3 through 10 of such timing unit are open.

It is believed expedient to here point out that a suitable source of direct electrical current, such as a battery of suitable voltage and capacity, is provided for energization of the previously mentioned solenoid windings of valves SV1 through SV9. However such source is not shown in the drawings for purposes of simplification thereof but its positive and negative terminals are designated B and N, respectively.

At times mentioned above, that is while vacuum and blow head assembly VBH1 is lowered in soak tank ST, while it is moving to its position shown in FIG. 1 and while it is then being lowered toward stripping plate STRP at its first position in its horizontal path of travel, vacuum is being supplied from a suitable source thereof (FIG. 22) over vacuum conduit VC to rotary union RU and thence to vacuum passage VB in shaft SH1 (FIG. 1) and to conduit CD to previously discussed mechanically actuated valve MV which is open to permit passage of vacuum so long as an actuating arm AA of such valve is not actuated to close off vacuum flow through the valve. That is to say, valve MV is spring biased to an open or vacuum flow condition so long as actuating arm AA of such valve is not actuated. When such actuating arm is actuated as discussed below, valve MV closes to interrupt vacuum flow therethrough. When actuating arm AA of valve MV is no longer actuated, the spring biasing feature of such valve again actuates such valve to open to again permit vacuum flow therethrough. Mechanically actuated valves such as MV are well known in the art. The vacuum supplied through valve MV, at the times mentioned above, flows through flexible conduit FC10 to assembly VBH1 to flow out of the bottom of such assembly and hold the aforesaid wetted decal thereto.

As previously mentioned, contacts 1 and 2 of timing unit TU are closed at the time under discussion and, therefore, electrical energy is being supplied from positive terminal B of said current source to electrical conductors C1 and C2, and thence to solenoid windings W5 and W3*a* of solenoid valves SV5 and SV3, respectively, and through such windings to terminal N of the current source. The energization of solenoid winding W3*a* actuates valve SV3 to its position shown in FIG. 22 so that compressed air flows from conduit CAC, which is connected to a suitable source of such air (FIG. 23) through the valve SV3 to flexible conduit FC3A and thence to the left hand side of rotary actuator RA to actuate crank arm CA of such actuator to the left to move stripping plate STRP to the left and to its said position below vacuum and blow head assembly VBH1. Flexible conduit FC3*b* connected to the right hand side of rotary actuator RA is, at such time, connected through valve SV3 to atmosphere or a suitable sink SK. The energization of winding W5 of solenoid valve SV5 actuates such valve to the left to supply vacuum from vacuum conduit VC over flexible conduit FC5 to vacuum and blow head assembly VBH2 while flexible conduit FC6, also connected to such assembly VBH2, is connected through valve SV6 to atmosphere or sink SK. If assembly VBH2 is supporting the transfer film of a decal at such time, the vacuum supplied through the bottom of such head holds such transfer film thereto.

During further driven actuation of timing unit TU, contact 3 of such unit closes and shortly thereafter contact 4 of the timing unit closes. The closing of said contact 3 energizes conductor C3 to energize winding W8 of solenoid valve SV8. This actuates such valve to supply compressed air from conduit CAC to flexible conduit FC8*b* while connecting flexible conduit FC8*a* to atmosphere or sink SK. The piston of cylinder CYL2 is thereby actuated downwardly at such time to move vacuum and blow head assembly VBH2 towards chuck CH. The closing of contact 4 of timing unit TU energizes conductor C4 and, thereby, winding W4 of solenoid valve SV4 to connect flexible conduit FC4*b* to compressed air conduit CAC while flexible conduit FC4*a* is connected to atmosphere or sink SK. The piston PR1 of cylinder CYL1 is thus actuated downwardly at such time to lower contact member CM into contact with the upper end of shaft 33 of vacuum and blow head assembly VBH1 in preparation for supplying compressed air through such shaft to such assembly and out of the bottom thereof. During the above mentioned downward movement of contact member CM, tool plate TP1 of turret machine T1 is moving downwardly and actuating arm AA of mechanical valve MV contacts an arm actuating member AM supported on turret T1 (FIG. 1) and actuating arm AA is thereby actuated to close off the vacuum being supplied through valve MV to flexible conduit FC10 and thence to assembly VBH1.

At the time of the above actuations, contact 5 of timing unit TU closes to energize conductor C5 and, thereby, winding W6 of valve SV6 and actuate such valve to supply compressed air from conduit CAC to flexible conduit FC6 and thence to assembly VBH2. Also at the same time, contact C1 of timing unit TU opens to deenergize conductor C1 and, thereby, winding W5 of valve SV5 to permit the spring of such valve to return it to the position shown in FIG. 23 to interrupt the supply of vacuum to assembly VBH2. These actions, as discussed below, cause a decal transfer film carried by assembly VBH2 to be transferred to a dish or dish-like article D carried by chuck CH (FIG. 20). Toward the completion of the downward movement of assembly VBH2 by the piston rod PR2 of cylinder CYL2, the plug member 71 and, thereby, resilient central member 90 of assembly VBH2 (FIG. 20) are forced out of the center hole 86*a* of resilient annular member 86 of such assembly because continued downward movement of body member 70 of assembly VBH2 is stopped by annular member 96 of such assembly contacting the brim CH*a* of chuck CH. A decal transfer film carried by assembly VBH2 is thus transferred to the upper surface of dish D by the compressed air being supplied to assembly VBH2 and the pushing of said central member 90 against the silk screen 92 on the bottom of such assembly. It is pointed out that, at such time, compressed air also flows through the radial passages such as 71*b* in plug member 71 of assembly VBH2 (FIGS. 15 and 20) and out of center hole 91 in central member 90 to further aid in the transfer of the decal transfer film to the upper surface of a dish such as D.

AT the time of the termination of vacuum to assembly VBH1 by the downward movement of turret T1 and the resultant actuation of mechanical valve MV as discussed above, contact 6 of timing unit TU closes to energize conductor C6 and thereby winding W1 of valve SV1. Such valve is, thereby, actuated to supply vacuum through the valve to flexible conduit FC1 and thence the stripping plate STRP for receipt by such plate of the decal being carried by assembly VBH1. Shortly thereafter contact 7 of timing unit TU closes to energize conductor C7 and thereby winding W7 of valve SV7. This actuates such valve to supply compressed air from conduit CAC through valve SV7 to flexible conduit FC7 and thence through contact member CM to the upper end of shaft 33 of assembly VBH1 to transfer the decal supported on the bottom of such assembly to stripping plate STRP to which vacuum is being supplied at such time, as mentioned above. It is pointed out that the decal on the bottom of assembly VBH1 is moved in very close proximity to, but out of contact with, the upper surface of stripping plate STRP when the piston rod PR1 of cylinder CYL1 has actuated contact member CM fully downwardly. Such full downward actuation occurs at the same time that said compressed air is supplied through contact member CM to assembly VBH1.

Timing unit TU next opens its contact 4 to deenergize conductor C4 and winding W4 of valve SV4. The spring of valve SV4 then returns valve SV4 to its position shown in FIG. 23 to again supply compressed air over flexible conduit FC4*a* to the lower end of cylinder CYL1 to again raise piston rod PR1 and contact member CM, and assembly VBH1 out of the aforesaid close proximity to the upper surface of stripping plate STRP. Flexible conduit FC4*b* is connected through valve SV4 to atmosphere or sink SK at such time.

Timing unit TU now opens its contact 2 to deenergize winding W3*a* of valve SV3 while at the same time contact 8 of the timing unit closes to energize conductor C8 and, thereby, winding W3*b* of valve SV3. This terminates the flow of compressed air to flexible conduit FC3*a* and connects such conduit to atmosphere or sink SK while compressed air is supplied through valve SV3 to conduit FC3*b* and thence to the right hand side of rotary actuator RA to rotate arm CA of such actuator to the right to, in turn, move stripping plate STRP, now carrying the water soaked decal, to the right and towards the aforesaid second position in the horizontal path of travel of such plate shown in FIG. 1. Just after the start of such movement of the stripping plate, contact 3 of timing unit TU opens to deenergize conductor C3 and, thereby winding W8 of valve SV8. The spring of valve SV8 reactuates such valve to its position shown in FIG. 23 and compressed air flows through the valve to conduit FC8*a* and to the lower end of cylinder CYL2 while conduit FC8*b* is connected through such valve to atmosphere or sink SK. The compressed air supplied to the lower end of cylinder CYL2 raises the piston of such cylinder and, thereby, piston rod PR2 to raise assembly VBH2 out of contact with chuck CH.

During the upward movement of assembly VBH2 and the movement of stripping plate STRP to the right and to its said second position in its horizontal path of travel, contact 9 of timing unit TU closes to energize conductor C9 and, thereby, winding W9 of solenoid valve SV9. Such valve is thus actuated to supply compressed air to flexible conduit FC9*b* and connect flexible conduit FC9*a* to atmosphere or sink SK. This supplies compressed air to the right hand end of cylinder CYL3 (viewing FIG. 23) and actuates the piston thereof and piston rod PR3 to the left to move assembly VBH2 in a corresponding direction, that is, from the aforesaid third position in the horizontal path of travel of assembly VBH2 towards the previously mentioned second position in such path, such position also being the second position in the horizontal path of travel of stripping plate STRP.

At the same time that contact 9 of timing unit TU closes as discussed above, contacts C6 and C7 of timing unit TU open to deenergize windings W6 and W7, respectively, of valves SV6 and SV7, respectively. Such valves are then actuated, by their respective spring return means, to terminate the flow of compressed air over conduits FC6 and FC7 to assembly VBH2 and contact member CM, respectively.

Assembly VBH2 and stripping plate STRP reach said second position in their said horizontal paths of travel (FIG. 1) and contact 1 of timing unit TU again closes to again energize winding W5 of valve SV5 and cause actuation of such valve to supply vacuum over flexible conduit FC5 to assembly VBH2 in preparation for the receipt by such assembly of the transfer film of the decal then being carried on the upper surface of stripping plate STRP. Next, contact 3 of timing unit TU closes to again energize conductor C3 and winding W8 of valve SV8 to again supply compressed air to the upper end of cylinder CYL2 and, thereby, move assembly VBH2 towards stripping plate STRP. During such movement of assembly VBH2, tool plate TP1 of turret machine T1 (FIG. 1) starts to raise and the actuating arm AA of mechanical valve MV moves out of contact with actuating member AM. Such movement permits valve MV to be reactuated to its vacuum flow condition and vacuum again flows through such valve to assembly VBH1. After the raising of tool plate TP1 of turret machine T1 such tool plate is rotated to move vacuum and blow head assembly VBH1*a* and another water-soaked water-release, slide-off decal carried on the bottom of such vacuum and blow head assembly (FIG. 1) towards the position of assembly VBH1 shown in FIG. 1. During the above mentioned raising of tool plate TP1 of turret machine T1 assembly VBH2 reaches its lowered position adjacent the upper surface of stripping plate STRP and the decal carried thereon. It is pointed out that, during the above-mentioned rotation of tool plate TP1 of turret machine T1 (FIG. 1) tool plate TP2 of turret machine T2 is also rotated to move another chuck such as CH*a*, carrying a dish or dish-like article whose upper surface is to be decorated, to the position of chuck CH shown in FIG. 1.

After the above mentioned lowering of assembly VBH2, contacts 8 and 2 of timing unit TU open and close, respectively, to deenergize and energize windings W3*b* and W3*a*, respectively, of valve SV3. This actuates such valve to interrupt the supply of compressed air to the right hand side of rotary actuator RA and supply such air to the left hand side of such actuator to start rotational movement of crank arm CA to the left and, thereby, movement of stripping plate STRP in a similar direction and towards the aforesaid first position in the horizontal path of travel of such stripping plate.

At the time of the above mentioned movement of assembly VBH2 to its lowered position, the bottom of such assembly lightly contacts the transfer film of the decal on the upper surface of stripping plate STRP. It is pointed out that, at such time, vacuum is being supplied to assembly VBH2 to draw the transfer film of the decal on the upper surface of stripping plate STRP to the bottom of the assembly VBH2 while, at the same time, vacuum is being supplied to stripping plate STRP to hold the backing paper of said decal to the upper surface of such plate. Thus, when the above mentioned movement of stripping plate STRP towards the left or towards its first position in its aforesaid horizontal path of travel begins, the backing paper of the decal is pulled or made to slide off of or from under the transfer film of the decal with the backing paper remaining on the upper surface of the stripping plate and the transfer film of the decal supported, by vacuum, on the bottom of assembly VBH2.

Following the above described operations, and during said movement of stripping plate STRP towards said first position thereof and carrying only the backing paper of the decal, contact 6 of timing unit opens to deenergize winding W1 of valve SV1 and the vacuum being supplied to stripping plate STRP is terminated.

Shortly thereafter contact 10 of timing unit TU closes to energize conductor C10 and, thereby, winding W2 of solenoid actuated valve SV2. Such energization of winding W2 actuates the valve to supply compressed air from conduit CAC to flexible conduit FC2 and thence to stripping plate STRP to blow against the bottom of the decal backing paper on such plate and raise the side thereof, above the orifices such as 19 (FIG. 4) in such plate, to aid in removal of the decal backing paper from the stripping plate which can for example, be performed manually.

At about the same time that air is supplied to the bottom of the backing paper as discussed above, contact 3 of timing unit TU again opens to energize conductor C3 and thence winding W8 of valve SV8 to permit the spring of such valve to return the valve to its position shown in FIG. 23 to again supply compressed air to the lower end of cylinder CYL2 and raise piston rod PR2 thereof and assembly VBH2 in preparation for a movement of such assembly in its right hand direction towards the aforesaid third position in the horizontal path of travel thereof and above a chuck such as CH (or CH*a*) being moved by tool plate TP2 of turret machine T2 as illustrated in FIG. 23.

When or just prior to assembly VBH2 reaching its raised position as discussed above, contact 9 of timing unit TU opens to deenergize conductor C9 and winding W9 and permit the spring of valve SV9 to return such valve to its condition shown in FIG. 23 thereby causing compressed air to flow through such valve and to flexible conduit FC9*a* and thence to the left hand end of cylinder CYL3 while the right hand end of such cylinder is connected through flexible conduit FC9*b* and valve SV7 to atmosphere or sink SK. Piston rod PR3 is thereby retracted within cylinder CYL3 to move carriage member CMA and assembly VBH2 to said third position in the horizontal path of travel of such assembly and over the chuck such as CH (or CH*a*) for application, in the manner previously described, of the transfer film then being carried by assembly VBH2 to the upper surface of a dish held by said chuck. Contact 10 of timing unit TU opens to deenergize winding W2 of valve SV2 and interrupt the supply of compressed air to stripping plate STRP which has now reached its first position below assembly VBH1 (or VBH1*a*) for receipt of another decal from such assembly, tool plate TP1 of turret machine T1 having now also completed its cycle of rotation in preparation for lowering of such tool plate as previously discussed. Contacts C3 through C10 of timing unit TU are all again open and contacts C1 and C2 of such timing unit are again closed as shown in FIG. 22. The remainder of the apparatus is also in the positions thereof illustrated in FIGS. 22 and 23 in preparation for another cycle of operations thereof such as just described.

It should be pointed out that, within limits, numerous small changes can be made in the timing of the actuations of contacts C1 through C10 of timing unit TU if found expedient to do so, so long as the sequence of such actuations are kept substantially as described. This will be readily apparent to those skilled in the art.

It should also be pointed out that, since vacuum is supplied through the bottoms of the vacuum or blow head assemblies such as VBH1 and VBH1*a* at all times except when such an assembly is lowered by tool plate TP1 of turret machine T1 at the location of VBH1 shown in FIG. 1, the decals can be supplied to the bottoms of such vacuum and blow head assemblies either manually or automatically at a location in advance of the location of soak tank ST in the path of movement of said assemblies by tool plate TP1.

Although there is herein shown and described only one form of apparatus for and method of practicing the invention disclosed, it will be understood that changes and modifications may be made therein within the purview of the appended claims without departing from the spirit and scope thereof.

What is claimed is:

1. In combination with an open top horizontally disposed chuck embodying a cavity holding a dish-like article whose upwardly facing surface is to be decorated, the apparatus comprising;

I. a depending and vertically actuable vacuum and blow head assembly above said chuck and including, a lower head portion having a larger diameter than said chuck and a downwardly disposed face of a resilient material, and having vacuum and compressed air orifices therein for alternatively supplying vacuum and compressed air through said face, and a stem support portion extending upwardly from said head portion;

II. a stretchable silk screen covering said face of said head portion of said assembly;

III. first actuable valve means for supplying vacuum through said vacuum orifices and said silk screen to hold the transfer film of a decal to such screen when said assembly is in other than its lower position;

IV. a plug member embodied in the center of said head portion and having a lower surface of a resilient material normally forming a part of said face of such head portion, such plug member being vertically movable out of the face of said head portion and embodying a plurality of compressed air radial passages connecting with a center hole embodied in said resilient material and said center hole opening through said lower surface of such material;

V. spring means for urging said plug member to its normally retracted position within said head portion;

VI. motor means including a vertically reciprocative output shaft attached to said stem support portion of said vacuum and blow head assembly for vertical actuation of such assembly;

VII. second actuable valve means for suppling compressed air through said compressed air orifices and through said silk screen and said radial passages and said center hole in said resilient material to blow against said transfer film when said assembly is actuated to its lower position by said motor means; and VIII. timing means for selectively controlling actuation of said first and second valve means and the energization of said motor means; whereby;

IX. when said assembly is actuated downwardly by said motor means and an outer annular part of said face of said head portion contacts the brim of said chuck, said plug member continues downwardly against the force of said spring means to stretch said silk screen and press said transfer film against said surface of said dish-like article while said first valve means are actuated to terminate said vacuum through said screen and said second valve means are actuated to supply compressed air through such screen and through said center hole in said resilient material to aid said plug memeber in applying said transfer film to said surface of said article.

* * * * *